US007439920B2

(12) United States Patent
Coates et al.

(10) Patent No.: US 7,439,920 B2
(45) Date of Patent: Oct. 21, 2008

(54) COMPACT SATCOM ANTENNA WITH INTEGRATED LNA

(75) Inventors: Chad Coates, Satellite Beach, FL (US); David L. Dunathan, Palm Bay, FL (US); Stephen Darnell Hughey, Melbourne, FL (US); Malcolm Packer, Fairport, NY (US); Kurt Alan Zimmerman, Indialantic, FL (US); Brent Eric Raiber, Springville, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/462,398

(22) Filed: Aug. 4, 2006

(65) Prior Publication Data

US 2008/0030408 A1 Feb. 7, 2008

(51) Int. Cl.
*H01Q 1/24* (2006.01)
*H01Q 9/16* (2006.01)

(52) U.S. Cl. ..... 343/702; 343/792

(58) Field of Classification Search ..... 343/702, 343/792, 709, 906; 455/575, 90
See application file for complete search history.

(56) References Cited

U.S. PATENT DOCUMENTS

| | | | | |
|---|---|---|---|---|
| 5,476,394 | A | 12/1995 | Sugihara et al. | |
| 6,720,929 | B2 * | 4/2004 | Nybeck et al. | 343/727 |
| 2006/0022892 | A1 * | 2/2006 | O'Neill et al. | 343/895 |
| 2007/0132650 | A1 * | 6/2007 | Lalezari | 343/773 |

FOREIGN PATENT DOCUMENTS

| | | | |
|---|---|---|---|
| EP | 0 767 508 | A2 | 4/1997 |
| WO | 97/13290 | A1 | 4/1997 |

* cited by examiner

*Primary Examiner*—Hoang V Nguyen
*Assistant Examiner*—Robert Karacsony
(74) *Attorney, Agent, or Firm*—GrayRobinson, P.A.

(57) ABSTRACT

A compact SATCOM antenna is provided having an LNA integrated into the radiator body which may be mounted to a handheld satellite radio and articulated with respect to the radio to assume a wide variety of positions for communication with a geosynchronous satellite.

6 Claims, 3 Drawing Sheets

COMPACT SATCOM ANTENNA WITH INTEGRATED LNA

FIELD OF THE INVENTION

This invention relates to satellite communication (SATCOM) antennas, and, more particularly, to a compact SATCOM antenna having an integrated low noise amplifier (LNA) which may be directly connected to a satellite radio and articulated to a wide variety of positions.

BACKGROUND OF THE INVENTION

Handheld and other types of satellite radios require an antenna to transmit and receive signals, and must be provided with sufficient gain to communicate with geosynchronous satellites. A number of suitable antennas have been developed in the past but most are relatively large and bulky, they must be unloaded from a container, backpack or the like and then folded-out for use. In many situations, time is of the essence and it is desirable to communicate "on-the-move" without stopping to assemble an antenna for the radio. Moreover, in the case of a handheld radio, the antenna must be compact and lightweight if it is to be used on-the-move so as not to interfere with the operation or transport of the radio.

An LNA is typically employed to enhance receive performance while reducing out-of-band interference and achieving high dynamic range. LNAs are active devices and require DC power. When integrated within an antenna, the LNA is powered and switched by the radio. The LNA improves cascaded system performance in terms of system noise figure by overcoming system losses that occur after the LNA.

SUMMARY OF THE INVENTION

This invention is directed to a compact SATCOM antenna having an LNA integrated into the radiator body which may be mounted to a handheld satellite radio and articulated with respect to the radio to assume a wide variety of positions for communication with a geosynchronous satellite.

The antenna of this invention is preferably a dipole antenna comprising a coupler adapted to connect to a satellite radio, a top radiator section, and, a bottom radiator section including a housing and a linkage extending between the coupler and the bottom radiator section. The top radiator section is preferably joined by a threaded connection to the bottom radiator section so that the two sections may be disassembled, as desired. The housing of the bottom radiator section encloses a printed circuit board which incorporates an LNA.

The linkage is preferably a gooseneck or other length of flexible conductor or the like which may be readily moved within wide range of positions relative to its point of connection to the coupler. This permits the radio operator to articulate the bottom radiator section, and, hence, the top radiator section, into polarization alignment with a satellite to be used for communication.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
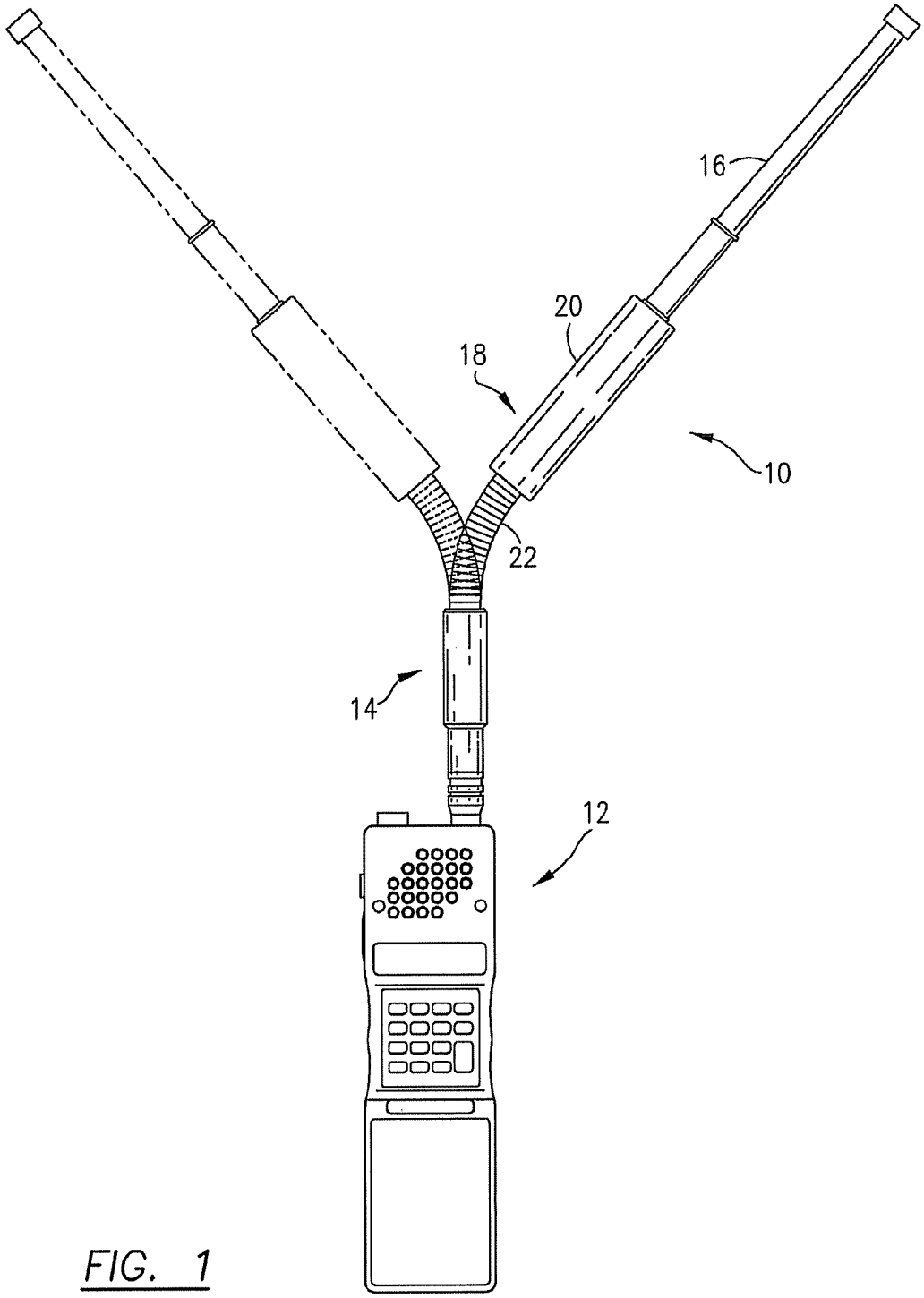
FIG. 1 is a front view of a handheld radio connection to the SATCOM antenna of this invention wherein articulation of the antenna is shown in dotted and solid lines.

Referring initially to FIG. 1, the SATCOM antenna 10 of this invention is shown connected to a handheld radio 12 by a coupler 14. The antenna 10 is preferably a dipole antenna having a top radiator section 16, and a bottom radiator section 18 which is formed by a circuit board housing 20 and a linkage 22. The linkage 22 is preferably a gooseneck or other form of readily bendable length of metal or similar flexible conductor which may be moved to a particular position and remain there until moved again. The degree of articulation of the linkage 22 is partially illustrated in FIG. 1 wherein the antenna 10 is depicted in both solid and phantom lines. It should be understood that the linkage 22 may also be moved in and out of the plane of the sheet on which FIG. 1 is depicted, as well as toward the radio 12, if desired. Further, the terms "top," "bottom," "inner" and "outer" as used herein refer to the position and/or direction of elements of this invention in the orientation in which they are shown in the Figs.

Figure 2:
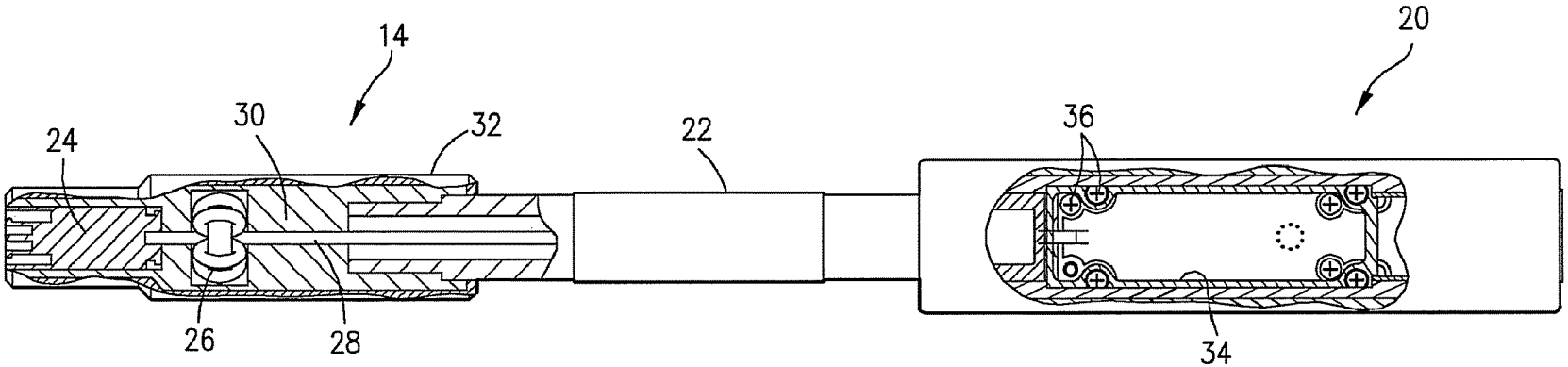
FIG. 2 is a cross sectional view of the coupler and the bottom radiator section of the antenna.

As best seen in FIG. 2, the coupler 14 includes a connector 24 and a balun 26 which are axially aligned with one another and coupled to one end of a coaxial cable 28. The connector 24 is preferably a threaded Neill-Concelman (TNC) connector, or other connector suitable for coupling the coaxial cable to radio 12. In order to form the coupler 14, one end of the linkage 22 is placed in axial alignment with the connector 24 and balun 26, and then all three components are encased within a non-conductive body 30 formed of epoxy or other suitable material which may be poured or injected over such components and thereafter cured to form a hardened structure which insures alignment of linkage 22 and connector 24. The body 30 is then covered by an overwrap 32, preferably in the form of a layer or layers of resilient material such as rubber or the like.

Figure 3:
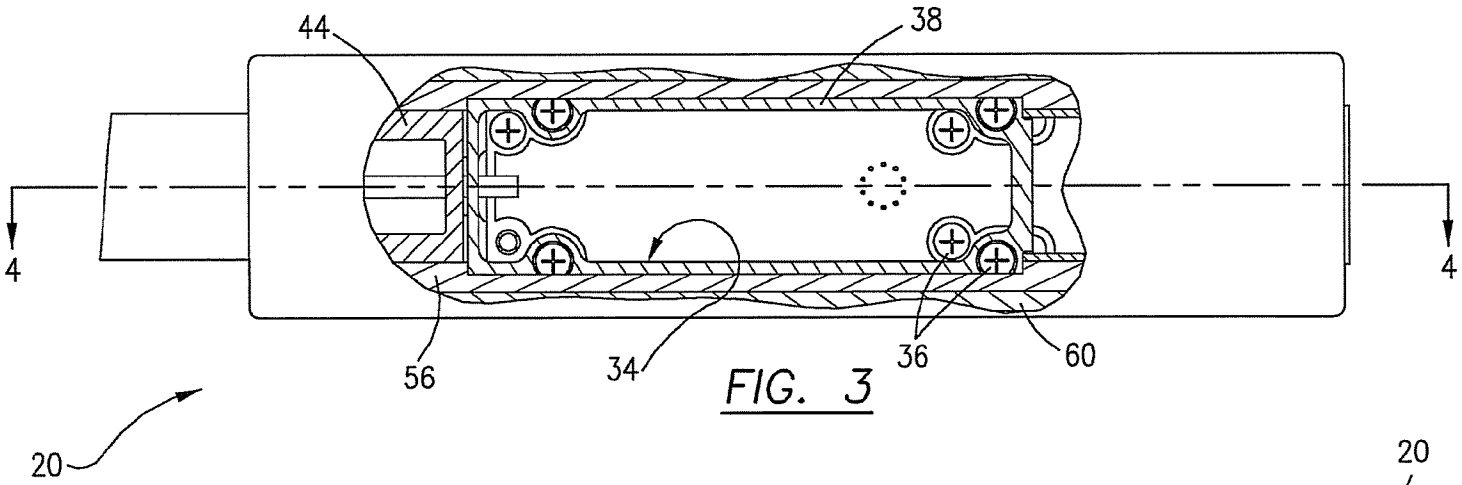
FIG. 3 is an enlarged view of that portion of the bottom radiator section depicted in cross section in FIG. 2.
Figure 4:
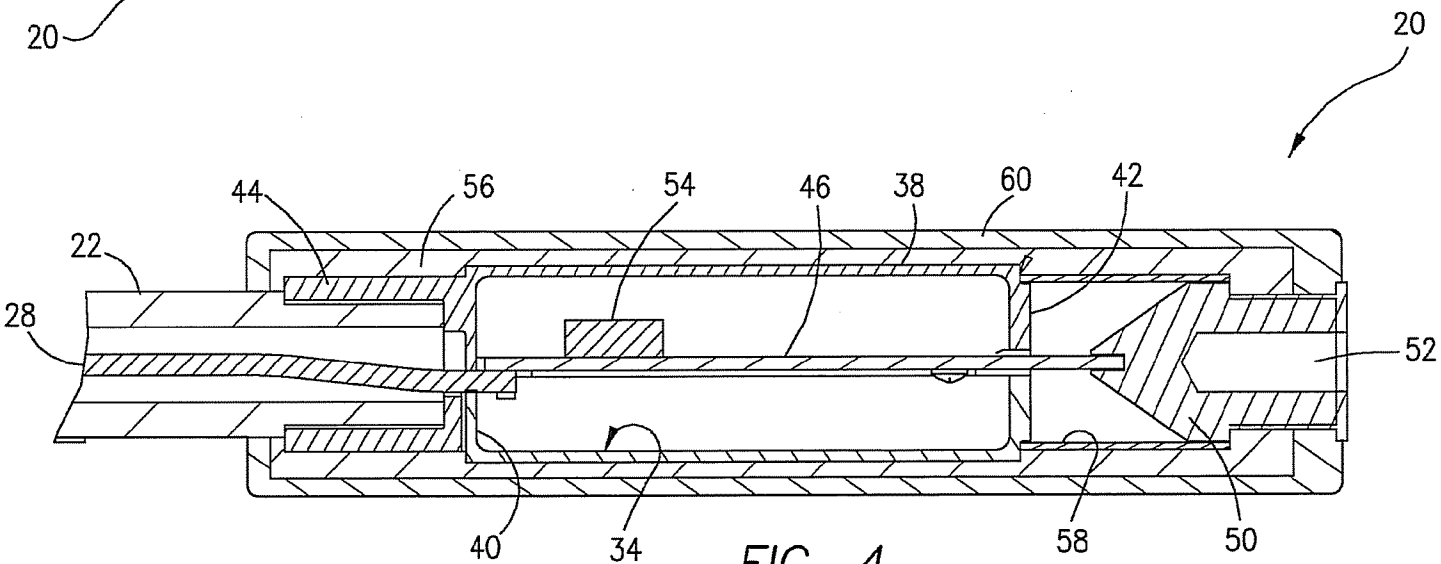
FIG. 4 is a cross sectional view taken generally along line 4-4 of FIG. 3.

Referring now to FIGS. 3 and 4, the circuit board housing 20 of the bottom radiator section 18 of the antenna 10 is shown in detail. Housing 20 includes a casing 34 preferably formed in the shape of a cylinder cut in half along its longitudinal axis, thus defining one half section depicted in FIG. 3 and a cover (not shown). The cover is connected by screws 36 to the other half of casing 34 in the locations illustrated in FIG. 3. The two halves of casing 34 define a side wall 38, opposed end walls 40 and 42, and, a cylindrical-shaped extension 44 which protrudes outwardly from the end wall 40. The extension 44 is connected to one end of linkage 22, such as by crimping or the like.

In the presently preferred embodiment, a printed circuit board 46 is mounted within the casing 34 in the position shown in FIG. 4. One end of the printed circuit board 46 connects to the end wall 40, and its opposite end extends past the end wall 42 into engagement with a slot formed in a conical conductor nut 50 having an internally threaded bore 52. The coaxial cable 28 from the coupler 14 extends through the hollow linkage 22 and connects to the printed circuit board 46 near the end wall 40. As schematically depicted in FIG. 4, the printed circuit board 46 includes an LNA 54 which is therefore integrated into the bottom radiator section 18 of the antenna 10.

The casing 34, and, hence, printed circuit board 46, as well as the nut 50 and a portion of the linkage 22, are preferably encased within a non-conductive body 56 of the same material as body 30 described above. Initially, the two halves of the casing 34 of the housing 20 are assembled, and a sleeve 58 formed of plastic or the like is slipped over the inner end of the conical conductive nut 50. The sleeve 58 prevents epoxy from entering the interior of casing 34 and contaminating the printed circuit board 46 as it is poured over the casing 34 and nut 50. Once the epoxy has cured to form non-conductive body 56, an overwrap 60 of the same type as overwrap 32 covers the body 56 and engages both the linkage 22 and nut 50. The casing 34, body 56 and overwrap 60 collectively form the housing 20 for the printed circuit board 46.

The top radiator section 16 is formed with a threaded extension (not shown) which is received within the threaded bore 52 of the nut 50 in order to connector the two radiator sections 16 and 18 together. This forms the completed antenna 10 as illustrated in FIG. 1. With the coupler 14 connecting the antenna 10 to the radio 12, the antenna 10 may be moved to essentially an infinite number of positions to align it with a satellite of interest. Because the LNA 54 is integrated into the bottom radiator section 18 of the antenna 10, transmission line losses are reduced. The radio 12 supplies 12 volts DC to both switch and power the LNA 54.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna for use with a satellite radio, comprising:

a coupler including a connector adapted to connect to a satellite radio, and a balun;

a first radiator section having a housing within which a printed circuit board including a low noise amplifier is mounted, and a flexible conductor connected between said coupler and said housing;

a second radiator section connected to said first radiator section, said flexible conductor permitting articulation of said first radiator section and said second radiator section relative to said coupler;

a coaxial cable coupled at one end to said connector and to said balun of said coupler, and at the opposite end to said printed circuit board of said first radiator section; and said connector, said balun and one end of said flexible conductor being axially aligned with one another and collectively embedded within a non-conductive body, said non-conductive body being overwrapped with a protective material to form said coupler.

2. The antenna of claim 1 in which said housing of said first radiator section includes a mount, said second radiator section being removably coupled to said mount.

3. The antenna of claim 2 further including a sleeve which encircles a portion of said mount and a casing which supports said printed circuit board, said sleeve, said casing and a portion of one end of said flexible conductor being encased with a non-conductive body, said non-conductive body being overwrapped with a protective material.

4. The antenna of claim 2 in which said mount is connected to said printed circuit board.

5. An antenna for use with a satellite radio, comprising:

a coupler including a connector adapted to connect to a satellite radio, and a balun;

a first radiator section having a housing within which a printed circuit board including a low noise amplifier is mounted, and a linkage connected between said coupler and said housing;

a second radiator section connected to said first radiator section, said linkage permitting articulation of said first radiator section and said second radiator section relative to said coupler;

a coaxial cable coupled at one end to said connector and to said balun of said coupler and at the opposite end to said printed circuit board of said first radiator section;

said connector, said balun and one end of said linkage being axially aligned with one another and collectively embedded within a non-conductive body, said non-conductive body being overwrapped with a protective material to form said coupler.

6. An antenna for use with a satellite radio, comprising:

a coupler including a connector adapted to connect to a satellite radio, and a balun;

a first radiator section having a housing within which a printed circuit board including a low noise amplifier is mounted, and a linkage connected between said coupler and said housing, said housing of said first radiator section including a mount;

a second radiator section removably coupled to said mount of said first radiator section, said linkage permitting articulation of said first radiator section and said second radiator section relative to said coupler;

a coaxial cable coupled at one end to said connector and to said balun of said coupler and at the opposite end to said printed circuit board of said first radiator section.

* * * * *